United States Patent [19]

Thein

[11] 4,265,312

[45] May 5, 1981

[54] METHOD FOR DEVELOPING WATER WELLS

[75] Inventor: Dennis J. Thein, Rochester, Minn.

[73] Assignee: Thein Well Company, Incorporated, Rochester, Minn.

[21] Appl. No.: 115,200

[22] Filed: Jan. 25, 1980

[51] Int. Cl.[3] ..... E21B 37/00; E21B 43/00

[52] U.S. Cl. ..... 166/312; 166/68

[58] Field of Search ..... 166/177, 242, 311, 312, 166/314, 68; 417/108

[56] References Cited

U.S. PATENT DOCUMENTS

| | | | |
|---|---|---|---|
| 746,980 | 12/1903 | Moran et al. | 417/108 |
| 1,153,253 | 9/1915 | Purdy | 417/108 |
| 1,547,197 | 7/1925 | Arbon | 166/314 |
| 1,798,774 | 3/1931 | Yates | 166/314 X |
| 2,061,865 | 11/1936 | Wells | 166/311 X |
| 2,713,908 | 7/1955 | Curtis | 166/312 X |
| 2,745,495 | 5/1956 | Taylor | 166/312 X |
| 2,942,663 | 6/1960 | Haggard | 166/312 |
| 4,223,724 | 9/1980 | Levoni et al. | 166/68 |

FOREIGN PATENT DOCUMENTS

| | | | |
|---|---|---|---|
| 2757484 | 6/1978 | Fed. Rep. of Germany | 166/312 |

OTHER PUBLICATIONS

*Ground Water and Wells,* pp. 303–305, 388, 389.
*Water Well Handbook,* p. 121.

*Primary Examiner*—James A. Leppink
*Assistant Examiner*—George A. Suchfield
*Attorney, Agent, or Firm*—Merchant, Gould, Smith, Edell, Welter & Schmidt

[57] ABSTRACT

A method and apparatus for removing particulate matter from the bottom of a drilled water well having a casing (10) open at its top. A pair of tubes (15 and 16) are lowered into the casing, the former outside the latter, so that their lower ends extend below the level of water in the well, the outer tube extending below the inner tube, to define a primary upward discharge path (31) and a secondary upward discharge path (143). Air is supplied (121, 122) to the top of the inner tube at such a pressure as to cause a primary discharge of fluid upward through the primary discharge path by air-lift operation. Valve means (140) is provided for intermittently first closing the primary discharge path, near the top of the outer tube, and afterwards suddenly reopening the primary discharge path to enable rapid gravitational return of water in the secondary discharge path and reestablish the primary discharge.

3 Claims, 4 Drawing Figures

23
141
V
TANK
COMP.
16
124
122
121
140
115
20
V
17
132
145
31
144
143
10
GROUND
100'
STATIC LEVEL
200'
DRAW-DOWN
115
250'
AIR PIPE 16
115
30
12
600'
CASING
13
710'
700'
27
WELL BOTTOM

METHOD FOR DEVELOPING WATER WELLS

TECHNICAL FIELD

This invention relates to the field of water supply, and particularly to improvements in the development of water wells after the drilling itself has been accomplished.

BACKGROUND OF THE PRIOR ART

"Well development" includes those steps in completing a water well that aim to remove the finer materials from the acquifer, thereby cleaning out, opening up, or enlarging passages in the formations so that water can enter the well more freely.

Whether the well has been drilled in an unconsolidated acquifer or in a hard rock formation, the drilling inevitably reduces the porosity of the acquifer in the neighborhood of the drill hole, whether by compaction of normally granular materials, or by deposition of fine materials from a drilling fluid. Known methods for restoring and even increasing the porosity of the acquifer at the bottom of the well hole include overpumping, mechanical surging, and surging with air.

The present invention is a procedure for developing a drilled well by the use of compressed air in such a way as to cause turbulence and vertical currents to carry any particulate matter through the well casing itself, and to cause water flow into as well as from the acquifer.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

DESCRIPTION OF THE PREFERRED EMBODIMENT

Figures 1, 2:
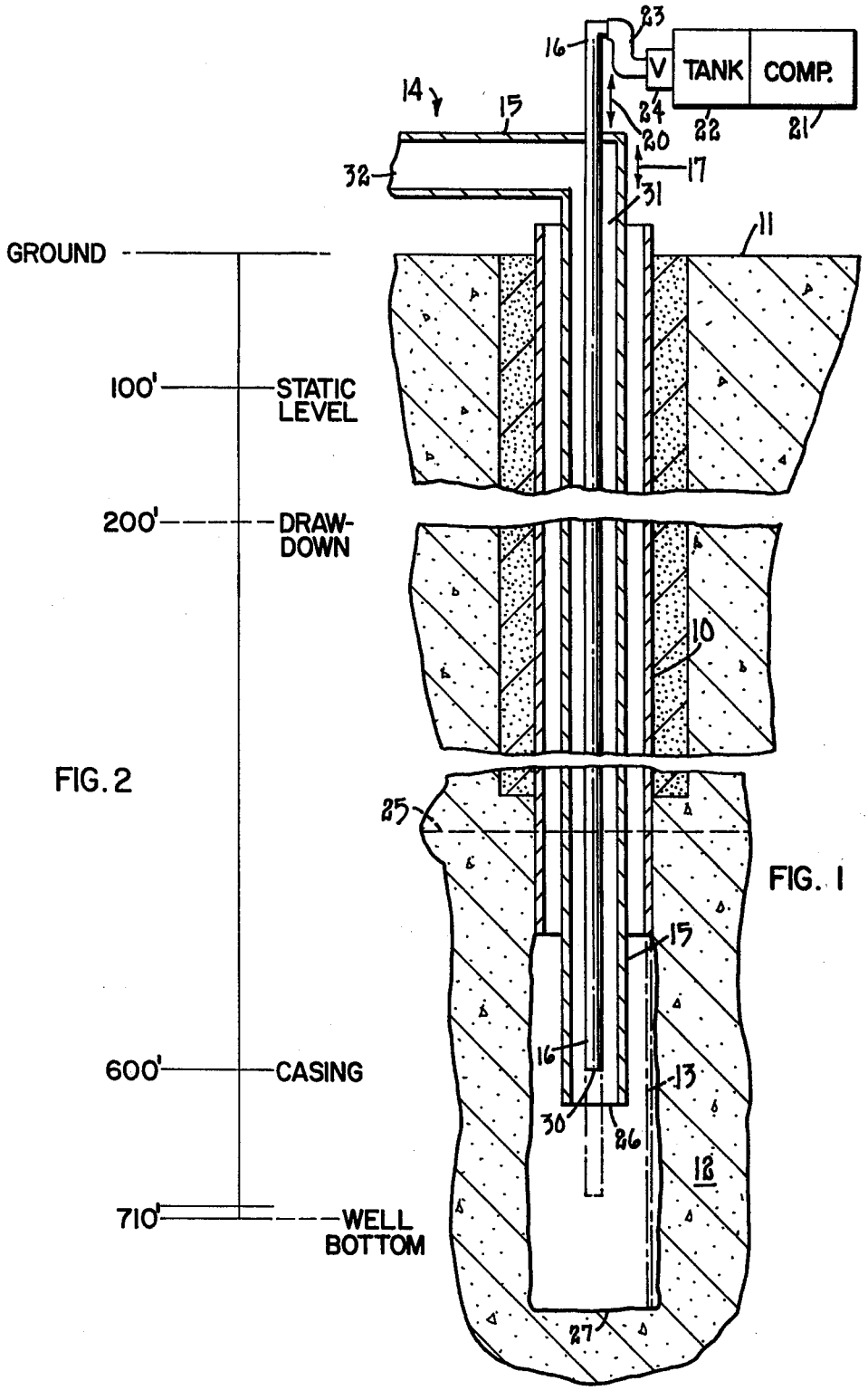
FIG. 1 shows a well developing arrangement according to the prior art.
FIG. 2 is a diagram illustrative of the operation of the arrangement of FIG. 1.

Reference should first be made to FIG. 1, which shows an air-surging well-developing system. Here a well casing 10 extends from the ground surface 11 to penetrate an acquifer 12 which is to supply water to the well: if the acquifer is unconsolidated, a screen 13 may be provided at the bottom of the casing.

In order to develop the well a "modified air-lift" 14 is lowered into the casing, comprising a pair of generally concentric tubes including an outer tube or eductor pipe 15 and in inner tube or air pipe 16. Means are provided for moving the assembly vertically in casing 10, as indicated at 17, and for moving the air pipe vertically within the eductor pipe, as indicated at 20. An air compressor 21 having a tank 22 is connected to air pipe 16 by a flexible pressure hose 23 and a quick-acting valve 24. The static level of water in the well is indicated at 25.

Air lift 14 is positioned so that the bottom 26 of eductor pipe 15 is about two feet above the bottom 27 of the well, or the bottom of screen 13. The bottom 30 of air pipe 16 is initially a foot or more above the bottom 26 of the eductor pipe. With valve 24 open, operation of compressor 21 causes an air flow which drives water downward out of air pipe 16. The air then flows through a primary upward discharge path 31 between air pipe 16 and eductor pipe 15, entraining with it water from the space between the inner and outer tubes, to comprise a primary discharge at 32. Additional water is drawn into eductor pipe 15 at its bottom, so that a flow of water from the acquifer through pipe 15 is established which carries away the water initially standing at the bottom of the well, together with whatever particulate matter or "fines" it may be carrying. This pumping operation may cause the level of the water in the well to fall by an amount identified as the "drawdown" of the air lift.

After the water discharging at 32 appears clear, valve 24 is closed, allowing pressure to build up in tank 22 to 120–150 psi. Meanwhile, the air pipe is lowered to project about a foot below the eductor pipe, as indicated in broken lines in FIG. 1. Valve 24 is now quickly opened to allow air from tank 22 to rush into the well. This surges water against the bottom of the well, and may also cause a brief but forceful overflow of water from the casing and the eductor pipe. The air line is now withdrawn into the eductor pipe, and air lift again draws water from the well, causing the particulate matter which has been loosened to be carried away. The operation is repeated, with the air lift at varying heights near the bottom of the well, until a flow of water free from fines results.

FIG. 2 is a schmatic showing of a typical water well which has been drilled from ground level 11 for a depth of 710 feet into a producing acquifer. The static level of water in the well is 100 feet below ground. A 24-inch bore has been extended downward 600 feet to a site where the bore encounters consolidated rock material, and lined with a 16-inch casing. The bore is continued at 16-inch diameter, no casing now being needed, to enter a sandstone acquifer. A six-inch eductor pipe and a two-inch air pipe extend almost to the bottom of the well.

Figures 3, 4:
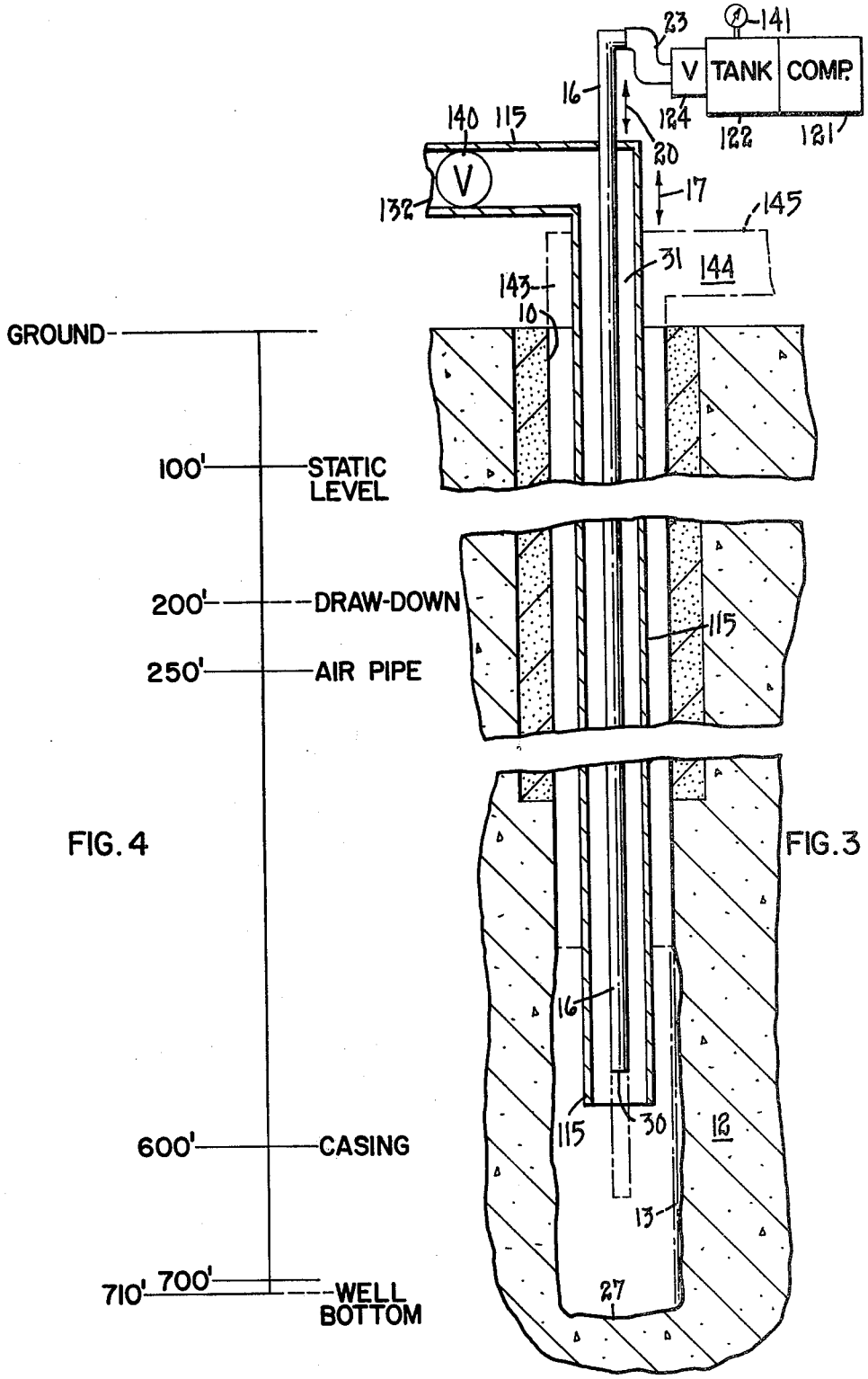
FIG. 3 shows a well developing arrangement according to the present invention.
FIG. 4 is a drawing like FIG. 2 but illustrative of the operation of the arrangement of FIG. 3.

Reference should now be made to FIG. 3, which shows a developing procedure according to my invention. Here well casing 10, ground line 11, air pipe 16, and hose 23 are as before. Eductor pipe 115 is provided at its top with a quick-acting valve 140. Compressor 121 must be of a considerably higher rating, tank 122 is provided with a pressure gauge 141, and valve 124 need no longer be a quick-acting valve.

For developing the well an initial air lift step is performed as previously described, valves 124 and 140 both being open, to result in a flow through primary discharge path 31 to a primary discharge at 132. Next valve 140 is closed and air pipe 16 is raised in eductor tube 115. Air drives water out of the bottom of tube 16 as before, air bubbles up in tube 115, but cannot escape because valve 140 is closed. The air accordingly pushes down the level of water in pipe 115 below the static level. The displaced water rises in a secondary upward discharge path 143 between eductor tube 115 and casing 10, the increasing air pressure necessary to accomplish this being indicated at 141. When compressed air has driven all the water out of eductor tube 115, the air bubbles up through secondary discharge path 143, entraining water with it as a secondary discharge 144 at the top of casing 10: a conduit 145 may be provided to lead this discharge away if its presence at the head of the well is unacceptable. No further increase in pressure is indicated at 141.

The upward velocity in path 143 is great enough to entrain particles of considerable magnitude, and to cause flow of water into the well from the acquifer, bringing into it particles and fines loosened from the acquifer. When the discharge at 144 is free of particles, valve 140 is suddenly opened. The entire mass of water in the secondary discharge path is now free to drop gravitationally, producing a water-hammer type of impact at the bottom of the well to cause reverse flow of water into the acquifer and produce great turbulence below the air lift. The impact is softened by the pressure relief available through the now open primary upward discharge path, but is nevertheless found very effective in breaking up compactions and liberating fines in the acquifer, and the freed particles may be removed by repeating the air-lift pumping step. The entire process may be repeated until no further release of particles results, when the development of the well has been completed.

FIG. 4 shows the well of FIG. 2 and indicates that while the eductor pipe is continued to a depth of 700 feet, the air pipe terminates at the depth of 250 feet. It is clear that in order to force water out of the eductor pipe the air pressure must be sufficient to overcome the weight of a column of water 450 feet high, or 198 pounds per square inch. Deeper wells may require even greater pressures. It has also been found desirable to have a continuous flow of 3,000–5,000 feet per minute, in order to assure that heavier particles are entrained and removed. It is evident that compressor 121 must have a high rating.

From the foregoing it will be evident that I have invented an arrangement for developing water wells by a procedure which uses air surging and provides primary and secondary discharge paths which are used to cause water flow into and out of the acquifer supplying the well, and to transport particulate matter out of the well.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. The method of removing particulate matter from the bottom of a drilled water well having a casing open at its top, which comprises the steps of (a) lowering a pair of tubes one within the other into said casing so that their lower ends extend below the level of the water in said well, with the outer tube extending below the inner tube to a site near the bottom of said well, to define a primary upward discharge path, between said outer tube and said inner tube, and a secondary upward discharge path, between said outer tube and said casing;

(b) supplying air to the top of said inner tube at such a pressure as to cause a primary discharge of fluid upward through said primary discharge path by air-lift operation;

(c) and intermittently first closing said primary discharge path near the top of said outer tube—to interrupt said primary discharge and compel said air to cause a secondary discharge of water downward through said outer tube, and then upward at high velocity through said second discharge path, to entrain said particulate matter—and afterwards suddenly reopening said primary discharge path to interrupt said secondary discharge, enabling rapid gravitational return of water in said secondary discharge path and reestablishing said primary discharge.

2. A method according to claim 1 including the further step of increasing the air pressure when said primary discharge path is closed.

3. A method according to claim 2 including the further steps of observing the pressure of air supplied to said air pipe and reopening said primary discharge path when said pressure ceases to increase.

* * * * *